US008545649B2

(12) United States Patent
Kim

(10) Patent No.: US 8,545,649 B2
(45) Date of Patent: Oct. 1, 2013

(54) METHOD FOR PREPARING NONWOVEN FUSIBLE INTERLINING USING PATTERN PRINTING

(75) Inventor: Si Hwan Kim, Seoul (KR)

(73) Assignee: Korea Vilene Co., Ltd., Pyeongtaek, Gyeonggi-Do (KR)

( * ) Notice: Subject to any disclaimer, the term of this patent is extended or adjusted under 35 U.S.C. 154(b) by 293 days.

(21) Appl. No.: 12/997,946

(22) PCT Filed: Jul. 24, 2009

(86) PCT No.: PCT/KR2009/004141

§ 371 (c)(1),
(2), (4) Date: Dec. 14, 2010

(87) PCT Pub. No.: WO2010/011108

PCT Pub. Date: Jan. 28, 2010

(65) Prior Publication Data

US 2011/0104457 A1 May 5, 2011

(30) Foreign Application Priority Data

Jul. 25, 2008 (KR) ..... 10-2008-0073155

(51) Int. Cl.

| | |
|---|---|
| ***B29C 61/02*** | (2006.01) |
| ***B32B 3/00*** | (2006.01) |
| ***B32B 38/14*** | (2006.01) |
| ***D04H 1/06*** | (2012.01) |
| ***D04H 1/54*** | (2012.01) |
| ***A41D 27/02*** | (2006.01) |

(52) U.S. Cl.
USPC ..... 156/62.2; 156/85; 156/280

(58) Field of Classification Search
USPC ..... 156/62.2, 85, 277, 280
See application file for complete search history.

(56) References Cited

U.S. PATENT DOCUMENTS

| | | | | | |
|---|---|---|---|---|---|
| 3,281,902 | A | * | 11/1966 | Kalwaites | 19/106 R |
| 3,914,493 | A | | 10/1975 | Graber et al. | |
| 4,170,680 | A | | 10/1979 | Cumbers | |
| 4,259,390 | A | | 3/1981 | Fahrbach et al. | |
| 4,696,850 | A | * | 9/1987 | Jost et al. | 428/197 |
| 5,290,594 | A | * | 3/1994 | Groshens et al. | 427/244 |
| 5,569,348 | A | | 10/1996 | Hefele | |
| 5,759,626 | A | | 6/1998 | Hefele | |

(Continued)

FOREIGN PATENT DOCUMENTS

| | | | |
|---|---|---|---|
| CN | 101189122 | A | 5/2008 |
| DE | 102005025550 | A1 | 12/2006 |

(Continued)

OTHER PUBLICATIONS

International Search Report for PCT/KR2009/004141 mailed Mar. 9, 2010.

(Continued)

*Primary Examiner* — Michael Tolin
(74) *Attorney, Agent, or Firm* — Edwards Wildman Palmer LLP

(57) ABSTRACT

Disclosed is a nonwoven fusible interlining fabricated through a pattern printing and a method for fabricating the same, and more particularly to a method for fabricating a nonwoven fusible interlining including the steps of processing a staple fiber and fabricating elastic nonwoven, pattern printing on the nonwoven, and applying an adhesive, and a nonwoven fusible interlining fabricated by the same. Therefore, it is possible to provide the variously shape-reinforced nonwoven fusible interlining through a simple and speedy fabricating process.

11 Claims, 9 Drawing Sheets

(56) References Cited

U.S. PATENT DOCUMENTS

| | | | | |
|---|---|---|---|---|
| 5,990,377 | A * | 11/1999 | Chen et al. | 604/381 |
| 2003/0143912 | A1 | 7/2003 | Black et al. | |
| 2009/0100565 | A1 * | 4/2009 | Grynaeus et al. | 2/69 |

FOREIGN PATENT DOCUMENTS

| | | | |
|---|---|---|---|
| FR | 2241604 | A1 | 3/1975 |
| GB | 1279087 | A | 6/1972 |
| GB | 1418227 | A | 12/1975 |
| GB | 1474455 | A | 5/1977 |
| JP | 08-296163 | A | 11/1996 |
| JP | 11-181661 | A | 7/1999 |
| JP | 2002-020956 | A * | 1/2002 |
| JP | 2003-313764 | A | 11/2003 |
| KR | 10-2004-0065428 | | 7/2004 |
| WO | WO 2007/000206 | A1 * | 1/2007 |
| WO | 2009-059651 | A1 | 5/2009 |

OTHER PUBLICATIONS

Japanese Office Action for Japanese Application No. 2011-519996, dated Jul. 10, 2012.

Chinese Office Action for Korean Application No. 2009-8024283.8, issued Nov. 27, 2012.

Supplementary European Search Report for EP 09800589, completed Nov. 29, 2011.

Japanese Office Action for Japanese Application No. 2011-519996, dated Jun. 11, 2013.

* cited by examiner

METHOD FOR PREPARING NONWOVEN FUSIBLE INTERLINING USING PATTERN PRINTING

CROSS-REFERENCES TO RELATED APPLICATIONS

This application is a U.S. national phase application, pursuant to 35 U.S.C. §371, of PCT/KR2009/004141, filed Jul. 24, 2009, designating the United States, which claims priority to Korean Application No. 10-2008-0073155, Jul. 25, 2008. The entire contents of the aforementioned patent applications are incorporated herein by this reference.

TECHNICAL FIELD

The present invention relates to a nonwoven fusible interlining fabricated through a pattern printing and a method for fabricating the same, and more particularly to a method for fabricating a nonwoven fusible interlining including the steps of processing a staple fiber and fabricating elastic nonwoven base fabric, pattern printing on the nonwoven base fabric, and applying an adhesive, and the method for preparing the same.

BACKGROUND ART

An interlining is applied to various clothes and secures the shape of the clothes. The interlining is divided into stable, bi-elastic, and mono-elastic interlinings according to provision of the shape stability depending on the direction, and should be selected according to fabric and type of clothes.

The material widely used for the interlining includes textile, knitted goods, and nonwoven, which have a unique characteristic, respectively. The nonwoven is fabricated by a simple process so that there is a limitation on providing various patterns. Contrary to this, the textile and the knitted goods have an advantage in that they can provide various properties depending on a type of thread and a weave pattern. Further, the textile and the knitted goods have excellent resistant properties and soft tactile sensation. However, if the nonwoven has the soft tactile sensation, the resistant property thereof is bad.

In general, the nonwoven used for the interlining is fabricated through mixing and calendering polyester and nylon, is stable in a longitudinal direction, and is extensible in a width direction. The nonwoven used for the interlining of clothes is fabricated in such a manner that the staple fiber is carded and thermal bonded, and then is applied with the thermoplastic adhesive. If the mixing ratio of the fiber and the thermal bonding pattern are changed, it is possible to fabricate the nonwoven interlining having various shape stability and tactile sensation. Further, in order to improve the tactile sensation and provide colors to the nonwoven interlining, the nonwoven interlining may be processed with mediclinical stuffs using an impregnating method. Furthermore, a functional material can be applied to the nonwoven interlining or the nonwoven interlining is processed in the form of a dot in order to provide functionality to the general nonwoven interlining. However, these processes are for making the nonwoven interlining to have a hard or soft tactile sensation or to have the functionality so that the application of the processes is limited.

Further, a stitching or composite reinforcement method is used for reinforcing strength of the nonwoven interlining (referring to FIG. 6). The stitching is a method of stitching the nonwoven base fabric with a thread so as to reinforce the strength in the longitudinal direction or provide elasticity in the width direction so that it is possible to provide the nonwoven with the soft tactile sensation and excellent shape stability, thereby being widely used. The composite is a method of inserting other material, such as the tactile having the excellent elasticity or shape stability, the spunbond, or the like, in an interlayer of the nonwoven so as to fabricate the nonwoven interlining. However, these methods can fabricate a product having excellent physical properties, but the fabricating speed is basically slow and complicated processes are required so that the cost competitive power is lower than that of the tactile. Further, these methods have a disadvantage in that it is difficult to reinforce the strength in a bias direction (referring to FIG. 6).

Therefore, the present invention was invented for solving the above problems, and variously changes the relatively simple physical property of the conventional nonwoven interlining through the pattern printing so as to contribute for manufacturing the more excellent clothes, and provides the nonwoven interlining with the advantage of the tactile and knitted goods.

DISCLOSURE OF INVENTION

Technical Problem

Therefore, the present invention has been made in view of the above-mentioned problems, and an object of the present invention is to provide a nonwoven interlining having various physical properties fabricated using a pattern printing and a method for fabricating the same.

Specifically, an object of the present invention is to reinforce the shape of the nonwoven interlining in a desiring direction using a various patterns printing, and especially the present invention can reinforce the strength in a bias direction.

Another object of the present invention is to provide the nonwoven interlining of which the thickness, elasticity, or the like, of the nonwoven interlining can be adjusted and the resistance is improved so as to fabricate the nonwoven interlining having the various physical properties.

Another object of the present invention is to considerably decrease the manufacturing cost of the nonwoven through the relatively simple fabricating process which is much faster than that of the tactile and knitted goods.

Technical Solution

In accordance with an aspect of the present invention, there is provided a method for fabricating a nonwoven fusible interlining, the method including the steps of: (a) mixing a staple fiber, processing the mixed staple fiber in a random web form using a carding machine, passing the random web through a calender roll for heat-bonding to fabricate elastic nonwoven base fabric; (b) pattern printing on the fabricated nonwoven base fabric; and (c) applying an adhesive to the pattern-printed nonwoven base fabric in a dot shape.

Preferably, the staple fiber mixed in step (a) comprises a heat shrinkable staple fiber selected from the group consisting of polyamide, polyester, Poly-trimethylene terephthalate (PTT), and polypropylene.

Preferably, the heat shrinkable staple fiber is mixed in an amount of 40 to 100% with respect to total weight of the nonwoven.

More preferably, the pattern printing is implemented by any one selected from the group consisting of a rotary screen method, a convex printing method, a concave printing method, and a flat printing method.

More preferably, the pattern printing is implemented by the rotary screen method.

Preferably, the pattern printing is implemented using resin selected from the group consisting of acrylic-based resin, urethane-based resin, polyester-based resin, glyoxal resin, polyolefin-based resin, and ultraviolet-curing resin.

More preferably, the pattern printing is implemented using the acrylic-based resin or urethane-based resin.

Preferably, the adhesive is selected from the group consisting of copolyester, copolyamide, polyurethane, and polyolefin.

More preferably, the adhesive is used in an amount of 5 to 35 g/m$^2$ with respect to an area of the nonwoven base fabric.

Preferably, the adhesive is applied by any one method selected from the group consisting of a powder scattering method, a paste printing method, a powder point method, a paste-powder-point method, or a melt printing method.

More preferably, the adhesive is applied by the paste-printing method.

Further, the present invention relates to a nonwoven fusible interlining fabricated by the above fabricating method.

Hereinafter, the present invention will be described in detail.

The method for fabricating the nonwoven fusible interlining according to the present invention includes the steps of fabricating elastic nonwoven base fabric, pattern printing for providing the nonwoven base fabric with shape stability, and applying an adhesive.

In order to provide the nonwoven base fabric with the elasticity in fabricating the nonwoven base fabric, a heat-shrinkable staple fiber should be mixed with a general staple fiber, and at this time, it is preferred that the heat-shrinkable staple fiber is used in an amount of 40%~100% with respect to the total weight of the nonwoven. Further, it is preferred that the staple fiber having the thickness of 0.7~3.0 denier and the length of 30~64 mm is used for fabricating the nonwoven.

The staple fiber is fabricated into the nonwoven base fabric through a carding process, a calendering process, and a heat shrinking process. In the calendering process, a calender roll uses a pattern having approximately 8~20% of a bonding area. Further, a hot blast dryer or an infrared heater is used in the heat shrinking process, and the combining temperature of 150° C.~250° C. is preferred.

The pattern printing process is implemented on the fabricated nonwoven fusible interlining with any one of rotary screen method, a concave printing method, a convex printing method, or a flat printing method.

It is preferred that the pattern printing uses a consecutive printing method to be-suitable for a speedy manufacturing process of the nonwoven. For being suitable for the pattern printing, the resin should have the excellent resistance against washing, the bonding weight of the resin is adjustable depending on the usage, and the weight of the resin after drying is about 5~30 g/m$^2$.

Generally, the pattern printing can use the concave printing, convex printing, or flat printing method. The rotary screen method is a scheme where the paste material is squeezed through out a mesh screen by a knife (referring to FIG. 5). The rotary screen method can easily design the desiring various patterns, can be easily applied to various materials, and can adjust the weight and thickness of the material desired for processing, so that it is most suitable for the present invention for usage. It is preferred that the screen for using is 40~155 mesh and the thickness thereof is 50~200 μm.

It is very important to select the pattern for providing the nonwoven interlining with the shape stability in a predetermined direction. Basically, the pattern is classified into for providing the stability in a longitudinal direction, in a width direction, and in a bias direction, and the various patterns are repeatedly used so as to provide the shape stability in the desiring direction. The pattern can be designed in the various shapes in which an angle in the bias direction is controlled so that it is possible to fabricate a product capable of replacing a conventional bias-cutting product of the stitch reinforcement interlining (referring to FIG. 6).

The adhesive can be applied through a powder scattering method, a paste printing method, a powder point method, a paste-powder-point method, or a melt printing method.

The powder scattering method is implemented by evenly dispersing and dropping the adhesive in the powder form on the nonwoven base fabric, melting the adhesive with heat, and bonding it (FIG. 7(*a*)). The paste printing method is implemented by evenly applying the adhesive processed in the form of paste to the nonwoven base fabric using a screen and a blade having the holes, heat-drying the adhesive, and bonding it (FIG. 7(*b*)). The powder point method is implemented by evenly transferring the adhesive in powder form on the nonwoven base fabric using a carved roll, melting the adhesive with heat, and bonding it (FIG. 7(*c*)). The paste-powder-point method is implemented by printing a binder on the paste and applying the adhesive in the powder form on it (FIG. 7(*d*)). The melt printing method is implemented by melting the thermoplastics adhesive so as to make it fluid, evenly applying the melted adhesive using the screen, and freezing and bonding it (FIG. 7(*e*)).

It is preferred that the adhesive is used in an amount of 5~35 g/m$^2$ with respect to the area of the nonwoven base fabric, which can be variable depending on the pattern. The adhesive is selected from a group consisting of copolyester, copolyamide, polyurethane, and polyolefin, in which it is preferred to use the thermoplastic polyurethane for the polyurethane.

Advantageous Effects

The fabricating method according to the present invention can easily fabricate the nonwoven interlining for various usages through the pattern printing method.

That is, the conventional reinforcement interlining is fabricated by a complex manufacturing process and can reinforce the shape only in a simple direction. However, the fabricating method according to the present invention can fabricate the nonwoven base fabric having the elasticity in both longitudinal and width directions and the reinforced strength even in the bias direction using the fiber material having the elasticity through the relatively simple fabricating process. Further, the fabricating method according to the present invention can fabricate the nonwoven base fabric having the shape stability variously suitable for the fabrics, the type of clothes, and the application area through the printing various patterns on the nonwoven base fabric. Accordingly, the present invention can dramatically improve productivity and decrease manufacturing costs, and further, can apply the nonwoven interlining to the area requiring only the expensive textile interlining or knitted interlining due to the low peeling resistance against the nonwoven interlining so that the cost of the sub-materials of the clothes can be lowered.

BRIEF DESCRIPTION OF DRAWINGS

FIG. 7A shows a powder scattering method. FIG. 7B shows a paste printing method. FIG. 7C shows a powder point method, FIG. 7D shows a paste powder point method, and FIG. 7E shows a melt printing method.

BEST MODE FOR CARRYING OUT THE INVENTION

Hereinafter, exemplary embodiments of the method for preparing nonwoven fusible interlining using pattern printing according to the present invention will be described in detail with reference to the accompanying drawings. However, the present invention is not limited to the embodiments but may be implemented into different forms. These embodiments are provided only for illustrative purposes and for full understanding of the scope of the present invention by those skilled in the art.

Exemplary Embodiment 1

Fabrication of Elastic Nonwoven Base Fabric

30~60% of the weight of heat-shrinkable polyester having 1.5 denier and the length of 38 mm was mixed with 40~70% of the weight of nylon staple fiber having 1.5 denier and the length of 38 mm and processed with a carding, calendering, and heat-shrinking process, so as to fabricate the elastic nonwoven base fabric.

Figure 1:
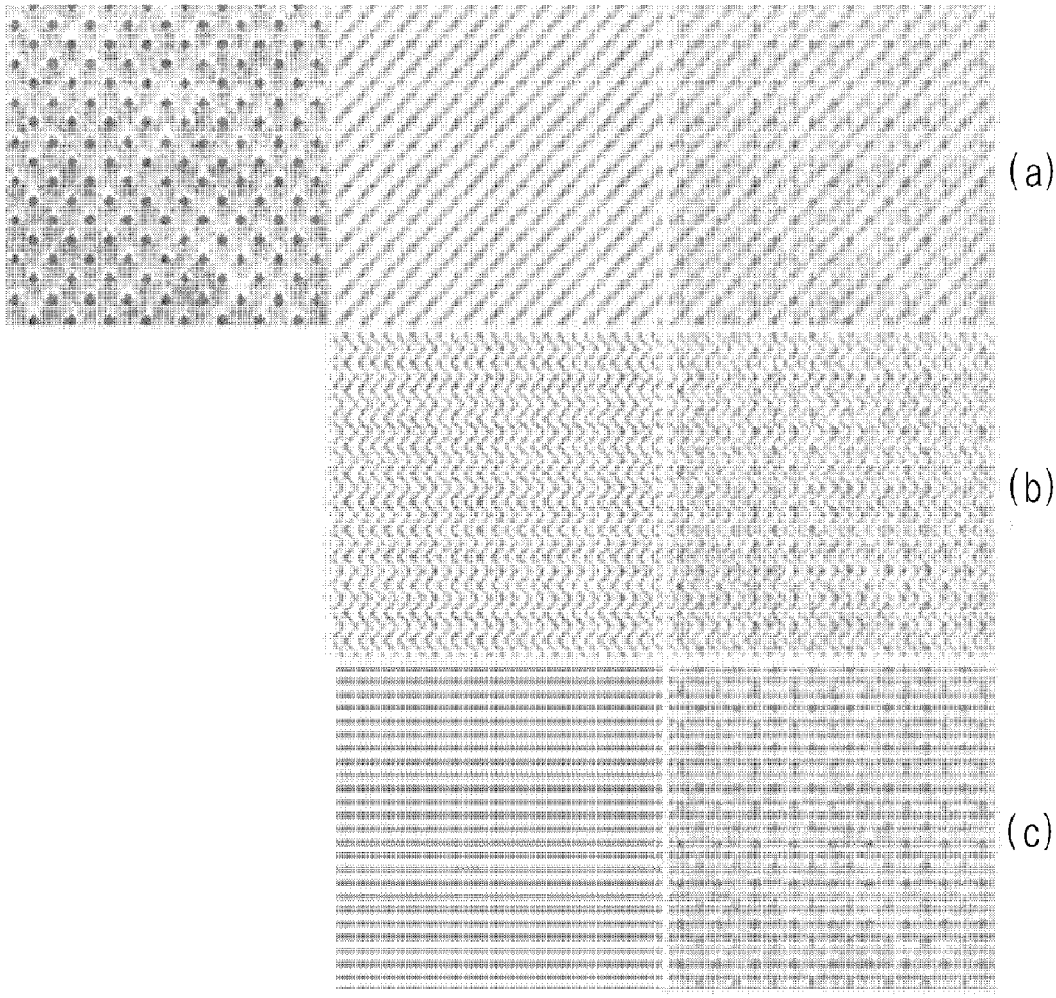
FIG. 1 are diagrams illustrating a structure of an interlining according to the present invention, i.e. row (a) is an interlining reinforced with strength in a bias direction, row (b) is an interlining reinforced with elasticity in a longitudinal direction, and row (c) is an interlining reinforced with strength in a width direction.
Figure 2:
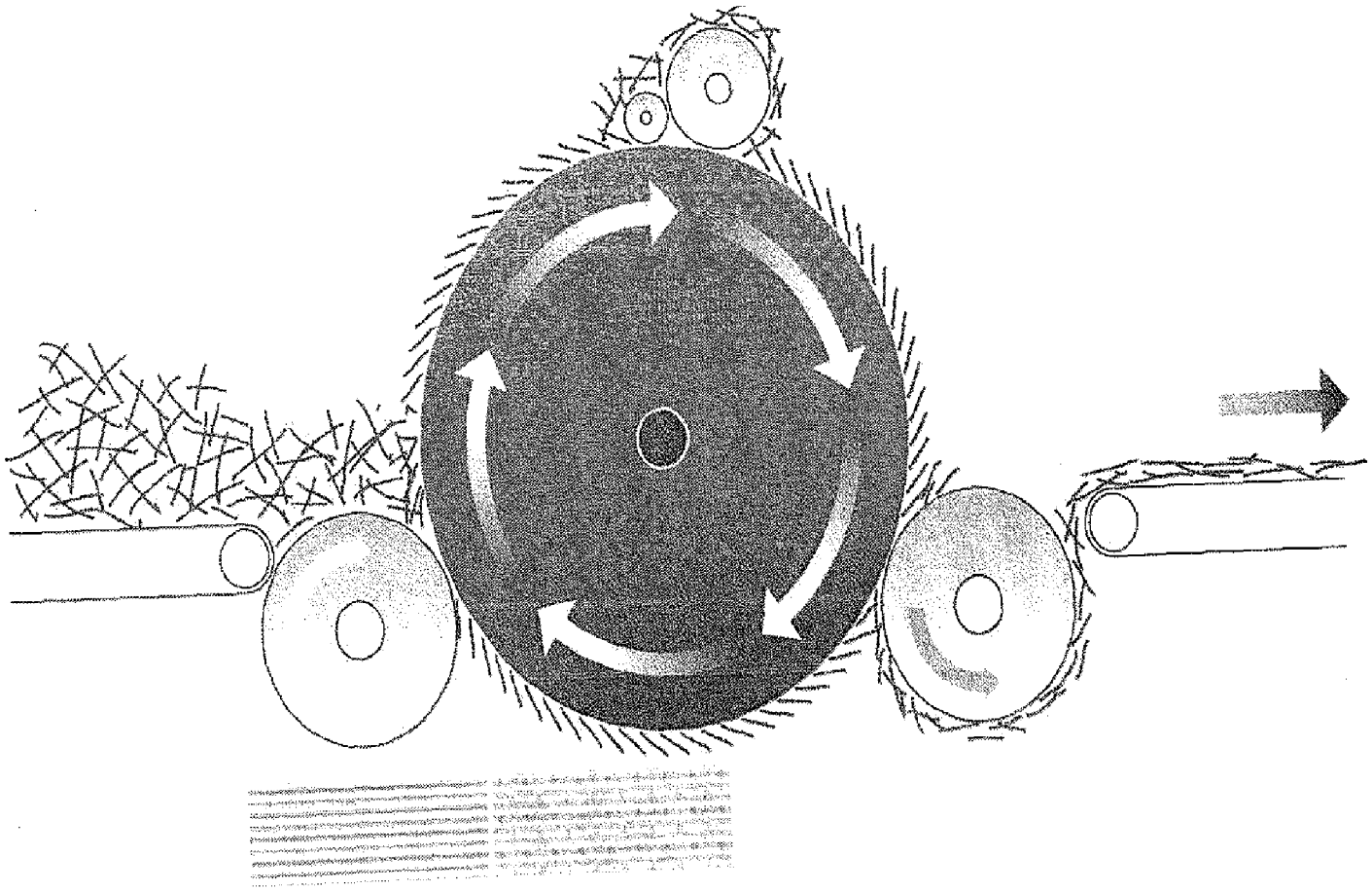
FIG. 2 is a diagram illustrating a carding process in the fabricating processes of the nonwoven interlining of the present invention.
Figure 3:
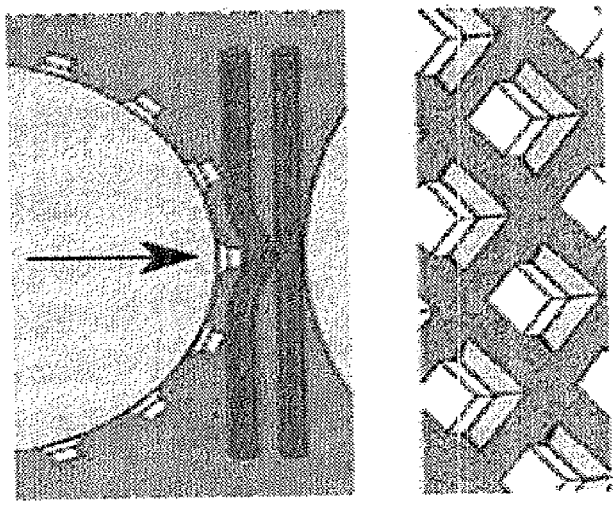
FIG. 3 is a diagram illustrating a calendering and heat-shrinking process in the fabricating processes of the nonwoven interlining of the present invention.
Figure 3:
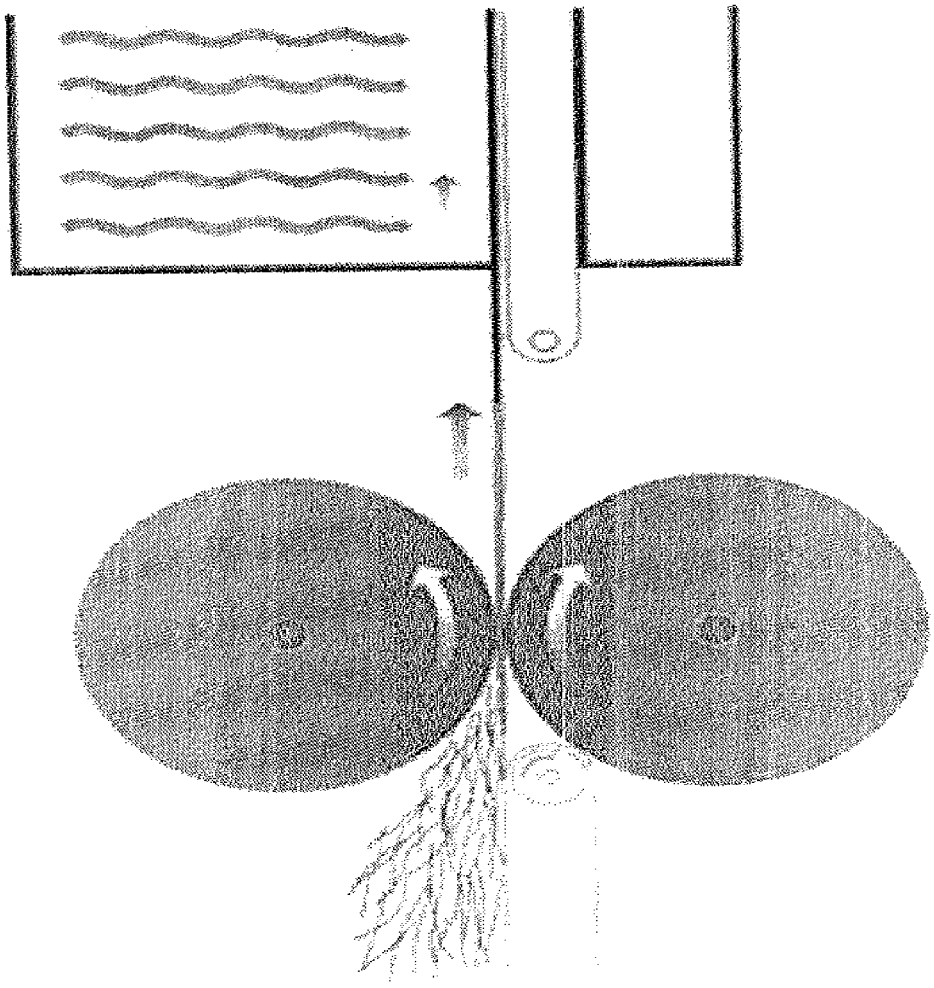
Figure 4:
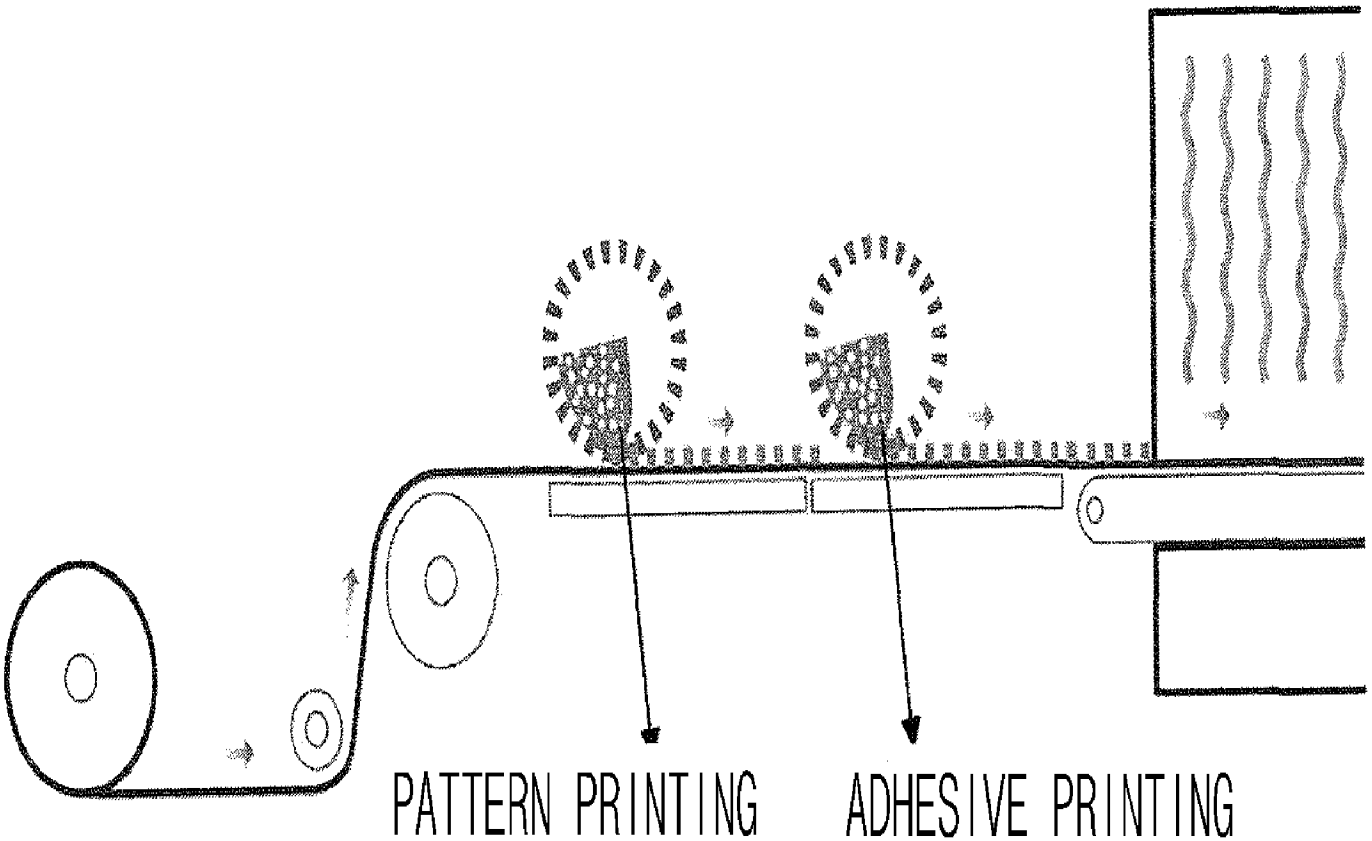
FIG. 4 is a diagram illustrating a pattern printing and an adhesive applying process in the fabricating processes of the nonwoven interlining of the present invention.

Specifically, each staple fiber was opened in an opening machine and evenly mixed in a mixing machine so as to fabricate a 15~50 g/m$^2$ random web through a high-speed random carding machine (a carding process, FIG. 2). The random web passed a calender roll engraved with a concave pattern and a flat calender roll and was mixed with each other by the pressure and the heat at 215~255° C. (a calendering process, FIG. 3). The pattern area of the engraved calender roll was 8~15% and the draft between the carding process and a heat bonding process was equal to or less than 10% for improving the elasticity. The fabricated nonwoven shaped like the web was processed at a temperature of 160° C. for 1 minute or more using a heat blast dryer to be heat-shrank. The nonwoven base fabric after heat-shrinking came to have recoverable elongation of 5~10% in a longitudinal direction and 10~30% in a width direction.

Exemplary Embodiment 2

Process of Pattern Printing

Figure 5:
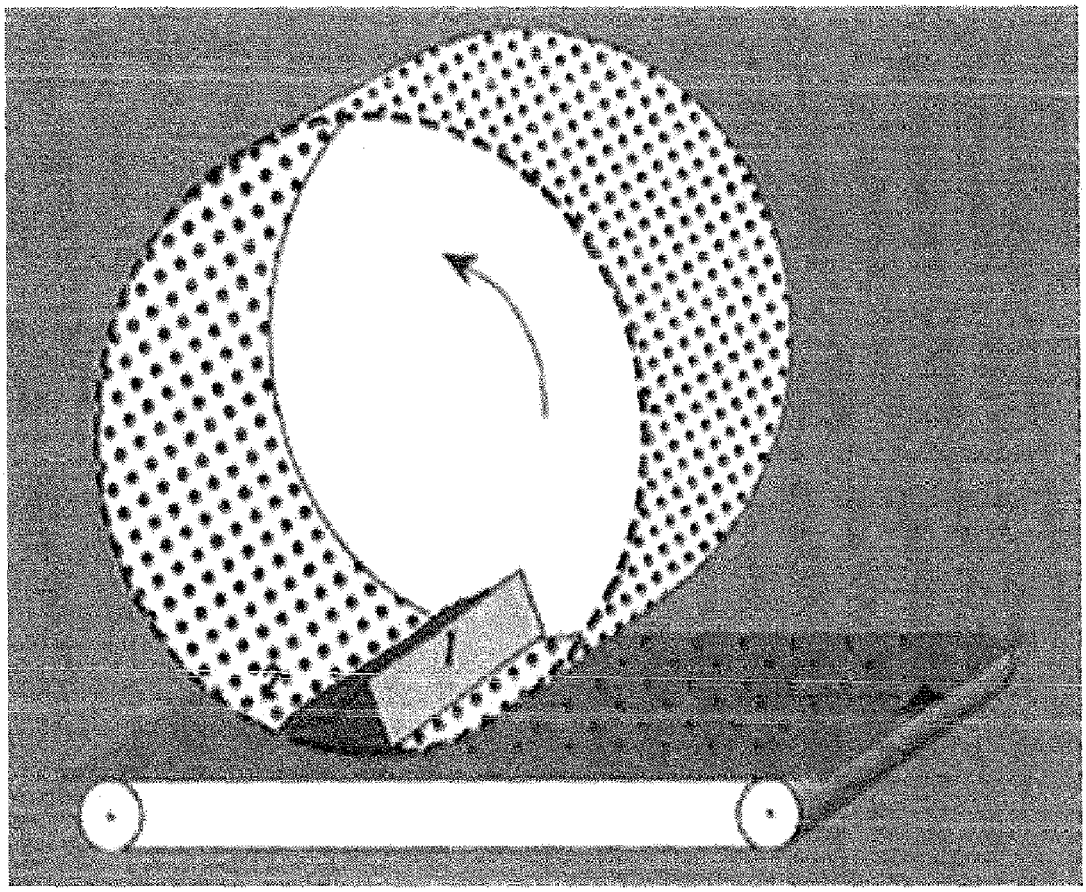
FIG. 5 is a diagram illustrating a rotary screen method in the pattern printing method.
Figure 6:
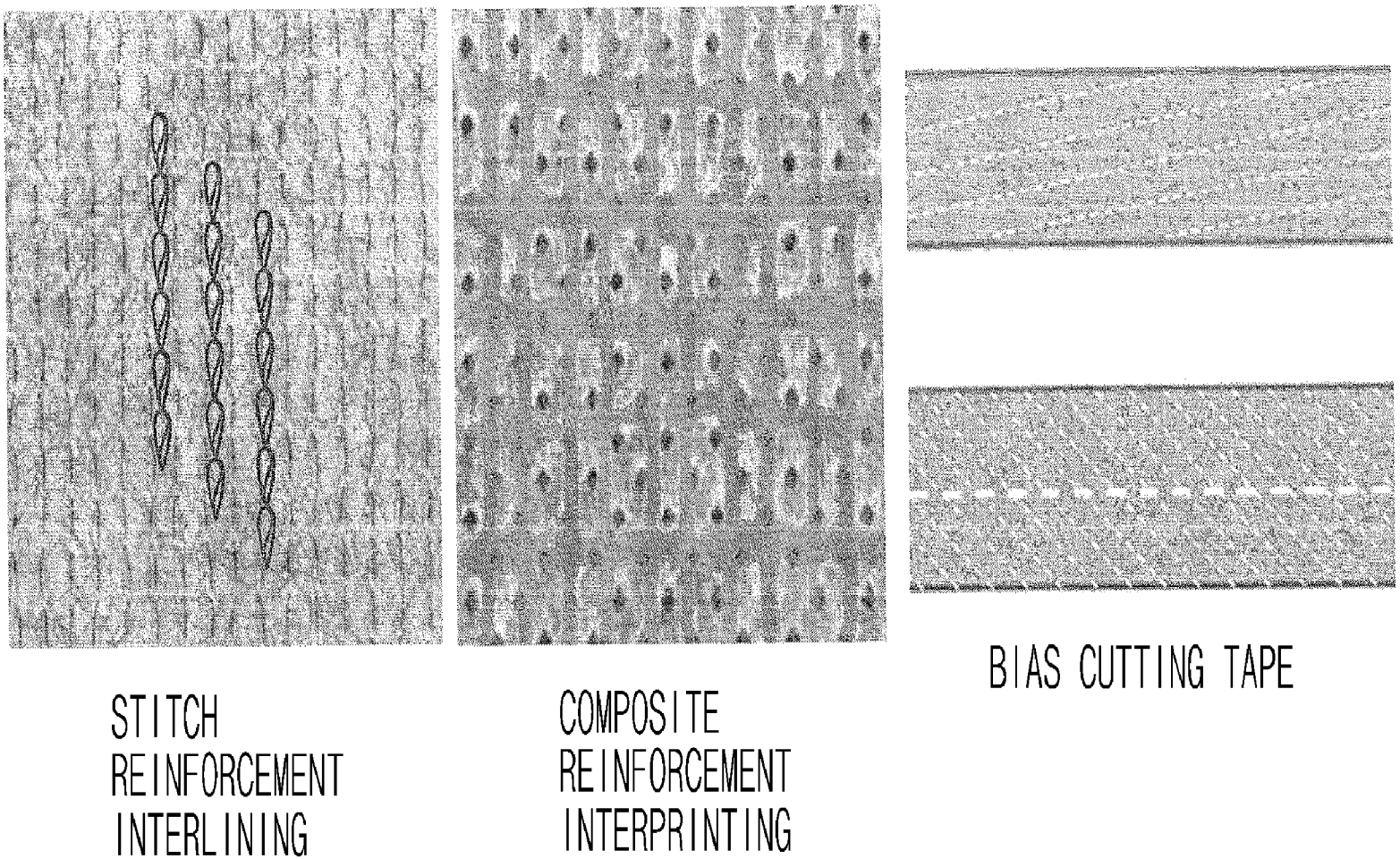
FIG. 6 is a diagram illustrating a general method for reinforcing the strength of the nonwoven interlining.
Figure 7A:
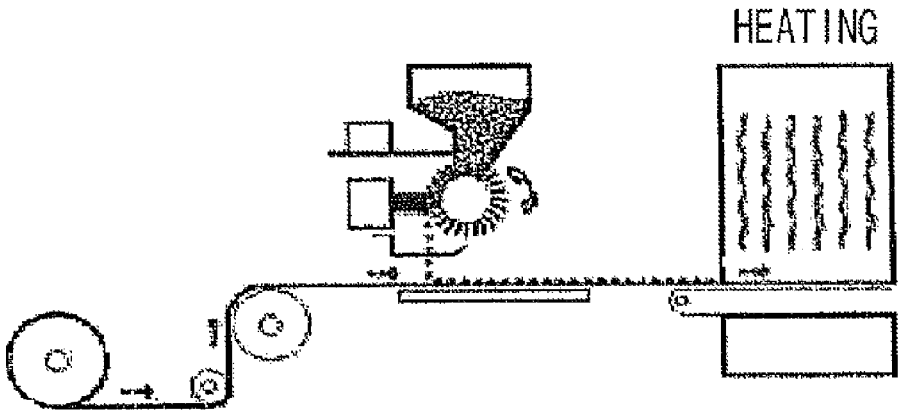
FIGS. 7A-E are diagrams illustrating the methods of applying the adhesive, i.e.
Figure 7B:
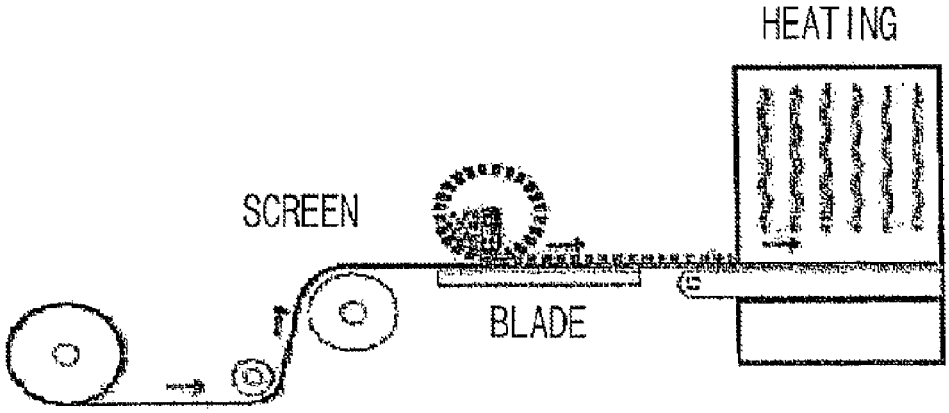
Figure 7C:
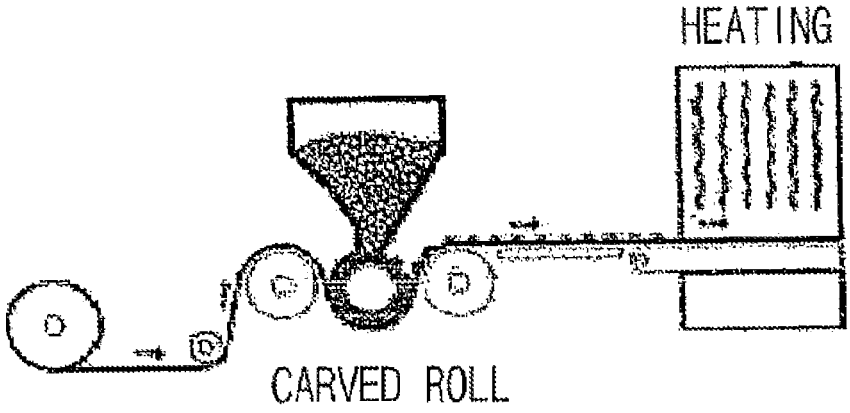
Figure 7D:
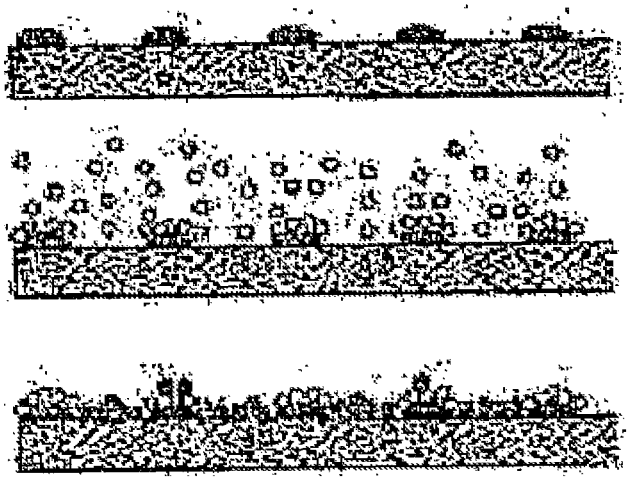
Figure 7E:
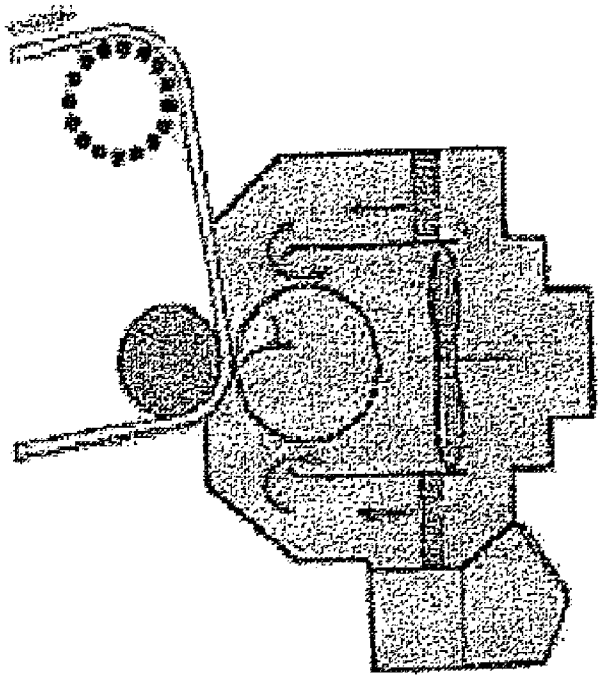

Acrylic-based resin and water-soluble urethane resin having a glass transition temperature of −35° C.~5° C. were used for the material of the pattern printing considering the tactile sensation and strength. At this time, the acrylic-based resin has excellent resistance against washing and the urethane resin has excellent elasticity. Further, a pigment, a blowing (foaming) agent, and a filing material were added for providing an additional property. Further, the pattern printing was implemented through the rotary screen method (FIG. 5).

Exemplary Embodiment 3

Process of Adhesive Application

A copolyamide-adhesive was applied to the nonwoven fusible interlining using the paste printing method and was processed with the number of dots of 37, 52, 110, or 180 per 1 cm$^2$ depending on the purpose for use. The adhesive was applied to the pattern-printed nonwoven base fabric in the shape of the dot and the bonding weight of the adhesive is 5~25 g/m$^2$.

The application of the adhesive to the pattern-printed nonwoven base fabric could obtain an effect of decreasing reverse exudation often occurring in the fusible interlining by the pattern printing. Further, the process of adhesive application could be performed not only separately from the pattern printing, but also integrally with the pattern printing for lowering the manufacturing cost.

The nonwoven interlining fabricated by the above processes represented the physical property as shown in Table 1. Table 1 represents the strength in the longitudinal direction, width direction, and bias direction, the thickness, and the elongation of the nonwoven interlining of 20~50 g/m$^2$.

TABLE 1

| Physical property | Conventional nonwoven interlining | Nonwoven interlining of the present invention |
|---|---|---|
| Strength in a longitudinal direction (kg/5 cm) | 1~5 | 2~10 |
| Strength in a width direction (kg/5 cm) | 0.2~1 | 0.4~3 |
| Strength in a bias direction (kg/5 cm) | | 0.4~1 |
| Thickness (mm) | 0.2~0.4 | 1 |
| Elongation in a longitudinal direction | | 10~15% |

As shown in Table 1, the nonwoven interlining of the present invention came to have the reinforced strength in the longitudinal and width directions. Especially, the strength in the longitudinal direction came to be reinforced up to the level similar with that of the interlining reinforced with the strength by stitching (about 5 to 12 kg/5 cm). Further, contrary to the strength-reinforced interlining by the stitching, the strength in the bias direction was also reinforced. Furthermore, through controlling the thickness of the binder, the thickness of the nonwoven could be increased two times or more than the general nonwoven interlining and the elasticity could be reinforced. That is, the elongation was increased from 5~10% to 10~15% by pattern printing.

Although an exemplary embodiment of the present invention has been described for illustrative purposes, those skilled in the art will appreciate that various modifications, additions and substitutions are possible, without departing from the scope and spirit of the invention as disclosed in the accompanying claims.

The invention claimed is:

1. A method for fabricating a nonwoven fusible interlining, the method comprising the steps of:

(a) mixing a general staple fiber with a heat shrinkable staple fiber, processing the mixed staple fiber into a web form using a carding machine, passing the web through at least a patterned calender roll for heat-bonding to fabricate an elastic nonwoven base fabric which has elasticity in both the longitudinal and width directions, and heat shrinking the elastic nonwoven base fabric by applying a heat source at a temperature of about 150° C. to about 250° C.;

(b) after heat shrinking the elastic nonwoven base fabric, pattern printing on the elastic nonwoven base fabric, wherein a pattern is selected based on a desired shape stability of the fabricated nonwoven base fabric in a longitudinal direction, width direction or bias direction; and (c) applying an adhesive to the pattern-printed nonwoven base fabric in a dot shape.

2. The method as claimed in claim 1, wherein the staple fiber mixed in step (a) comprises a heat shrinkable staple fiber selected form the group consisting of polyamide, polyester, Poly-trimethylene terephthalate (PTT), and polypropylene.

3. The method as claimed in claim 2, wherein the heat shrinkable staple fiber is mixed in an amount of 40 to 100% with respect to total weight of the nonwoven.

4. The method as claimed in claim 1, wherein the pattern printing is implemented by any one selected from the group consisting of a rotary screen method.

5. The method as claimed in claim 1, wherein the pattern printing is implemented using resin selected from the group consisting of acrylic-based resin, urethane-based resin, polyester-based resin, glyoxal resin, polyolefin-based resin, and ultraviolet-curring resin.

6. The method as claimed in claim 5, wherein the pattern printing is implemented using the acrylic-based resin or urethane-based resin.

7. The method as claimed in claim 1, wherein the adhesive is selected from the group consisting of copolyester, copolyamide, polyurethane, and polyolefin.

8. The method as claimed in claim 7, wherein the adhesive is used in an amount of 5 to 35 $g/m^2$ with respect to an area weight of the nonwoven base fabric.

9. The method as claimed in claim 1, wherein the adhesive is applied by any one method selected from the group consisting of a powder scattering method, a paste printing method, a powder point method, a paste-powder-point method, or a melt printing method.

10. The method as claimed in claim 9, wherein the adhesive is applied by the paste-printing method.

11. The method of claim 1, wherein the web is about 15-50 $g/m^2$ and is produced by a high speed random carding machine.

* * * * *